United States Patent [19]

Winiker

[11] Patent Number: 5,032,226

[45] Date of Patent: Jul. 16, 1991

[54] BASE PAPER FOR PHOTOGRAPHIC LAYER SUPPORT

[75] Inventor: Robert Winiker, Hasbergen, Fed. Rep. of Germany

[73] Assignee: Felix Schoeller Jr. GmbH & Co., KG, Osnabrück, Fed. Rep. of Germany

[21] Appl. No.: 310,362

[22] Filed: Feb. 10, 1989

[30] Foreign Application Priority Data

Feb. 16, 1988 [DE] Fed. Rep. of Germany ..... 3804776

[51] Int. Cl.[5] ..... D21H 17/05; D21H 17/33

[52] U.S. Cl. ..... 162/158; 162/164.3; 162/164.6; 162/168.3; 162/179; 162/180; 162/183

[58] Field of Search ..... 162/158, 168.3, 179, 162/183, 164.3, 180, 164.6, 168.2

[56] References Cited

U.S. PATENT DOCUMENTS

| | | | |
|---|---|---|---|
| 2,884,058 | 4/1959 | Schuller et al. | 162/168.3 |
| 4,419,433 | 12/1983 | Kubbota et al. | 162/158 |
| 4,433,030 | 2/1984 | Tamagawa et al. | 428/476.9 |
| 4,439,496 | 3/1984 | Tamagawa et al. | 428/513 |
| 4,659,430 | 4/1987 | Tamagawa et al. | 162/135 |
| 4,665,014 | 5/1987 | Katsura | 430/538 |
| 4,675,245 | 6/1987 | Von Meer | 428/328 |

OTHER PUBLICATIONS

Casey, *Pulp and Paper*, 3rd ed., vol. III (1981), p. 1603.

Casey, *Pulp and Paper*, 3rd ed. (1981) pp. 1449–1459.

*Primary Examiner*—Peter Chin

*Attorney, Agent, or Firm*—Horst M. Kasper

[57] ABSTRACT

A photographic layer carrier, made of a paper coated with polyolefin resin with improved sheet structure and improved strength values, comprises a base paper which includes, in additon ot hydrophobic-properties conveying sizing agent and a cationic wet-proof-properties conveying agent, an amphoteric polyacryl amide and/or polymethacryl amide.

16 Claims, No Drawings

BASE PAPER FOR PHOTOGRAPHIC LAYER SUPPORT

BACKGROUND OF THE INVENTION

1. Field of the Invention

The invention relates to a base paper for waterproof coated paper carriers for photographic layers as well as a method for the production of such a base paper for the production of layer carriers.

2. Brief Description of the Background of the Invention Including Prior Art

It is known to employ paper laminate coated on two sides with hydrophobic resin layers as carrier material for photographic layers to be developed with a wet process. Such a carrier material comprises in a widely used embodiment a base paper with polyolefin resin coatings applied to both surfaces. The coating disposed next to the photographic layers contains usually at least one light-reflecting pigment such as, for example, titanium dioxide.

A paper provided on the two surfaces with a water-impermeable resin layer is protected on its faces against an entering and penetrating of water or of aqueous photographic processing solutions, but it is not protected at the open edges, where the paper core of the laminate is freely exposed. Aqueous processing solutions can therefore penetrate at the edges of the laminate into the paper core and cannot be removed without residue by the usual wash processes.

In order to prevent or, respectively, to decrease this penetration of acqueous solutions at the edges of the laminate, the base paper is usually hard sized. Both, reactive materials, such as for example dimerized alkylketene, as well as non-reactive materials, such as higher fatty acids, are known as sizing agents for photographic base paper (Journal of Applied Photographic Engineering 7, 1981, pp. 67–72). Reactive sizing agents are usually processed in the presence of a cationic resin without a pH-change, i.e. "neutral". Non-reactive sizing agents require for fixing an addition of aluminum ions and are processed in acid solutions. The U.S. Pat. No. 4,659,430 teaches in addition a combination of these two sizing processes in order to protect the paper core still more against the penetration of the various components of photographic processing solutions.

The sizing agents, acting to impart hydrophobic properties, are usually added to the fiber suspensions and are deposited by addition of auxiliary agents on the surface of the fibers. Such an auxiliary agent is, for example, an aluminum salt in the case of an acid sizing and, in case of a neutral sizing, for example, a cationic polyamide-polyamine-epichlorohydrine resin, which is employed predominantly together with $C_{16}$–$C_{18}$-alkylketene dimer (Journal Applied Photographic Engineering 7, 1981, pp. 67–72). However, also other cationic materials, such as cationic polyacryl amides, cationized starches, or polyethylene-imines, are suitable in certain cases for the improvement of the retention and for the fixation of reactive sizing agents in the paper sheet.

Since the sizing agents are deposited at the surface of the paper-making pulp fibers, naturally, fiber-fiber-bonding becomes weaker in a sized paper as compared to a non-sized paper. Consequently, additional water-soluble resins are widely employed in order to improve the paper strength. Such resins include for example polyvinyl-alcohol, anionic or cationic polyacryl-amide, guar resin or gum, and various starch derivatives. Guar resin or guar gum is a water-soluble mucilage obtained from Cyanopsis tetragonoloba with the water-soluble portion of the guar flour containing about 35% galactose, 63% mannose, and 5 to 7% protein.

U.S. Pat. No. 4,665,014 describes for example the use of anionic polyacryl amide together with cationic starch. U.S. Pat. No. 4,433,030 teaches the additional use of cationic polyacryl amides and U.S. Pat. No. 4,439,496 teaches the use of anionic polyacryl amide together with cationic polyacryl amide, whereas U.S. Pat. No. 4,675,245 describes a combination of cationic resin with anionic polysaccharide derivatives. The addition of the strengthening resins serves at the same time the purpose to decrease the discoloring of the edges by the developer.

However, not only the loss of strength is disadvantageous in a hard sizing of the base paper, where the decrease in the structural strength is particularly damaging in case of laminates. In particular, it is disadvantageous that the use of flocculating auxiliaries influences disadvantageously the sheet formation. This is based on the fact that the addition of cationic materials not only retains the sizing agent at the fiber surface but, in addition, unavoidably and despite counteracting machine-technical measures, fiber flocs form at an increased extent, because the repulsive negative charges of the fibers are substantially neutralized by the cationic materials and fiber-fiber-bridge formations are facilitated. Depending on the materials used and the machine-technical apparatus, the fiber flocs have various sizes and distribution in the paper sheet, and they determine the homogeneity and the surface quality of the base paper. The structure, once formed in the paper sheet, can no longer be changed even by intensive calendering.

The described combined use of cationic and anionic water-soluble resins achieves in fact a decrease of the bath penetration at the cutting edges, as described in the U.S. Pat. No. 4,665,014, U.S. Pat. No. 4,439,496, U.S. Pat. No. 4,433,030, or the U.S. Pat. No. 4,675,245. However, the problem of the sheet formation, the surface quality, and the structural strength have not been considered in these references. Only in the U.S. patent application, Ser. No. 019,580, have these two points been considered in, but only in connection with an acid sizing.

The combined use of anionic and cationic resins regularly results in inferior the sheet formation in neutral sized papers. In addition, the structural and textural strength of the paper sheet decreases frequently because, in case of an unstable control of the process, isolated flocs of anionic and cationic resin are generated, which are deposited and included into the paper web without generating a strengthening effect.

In order to avoid these flocculation problems, it has been attempted to add to the cellulose suspension non-ionic polymers such as, for example, starch, polyvinyl alcohol, or guar gum. In fact, this resulted in a certain improvement in the sheet formation and the surface quality, however, the retention of these materials was substantially worse, the production speed had to be reduced and, after treatment with the photographic processing solutions, the internal strength turned out to be substantially decreased. The edges of the coated layer carriers were split under conditions of photographic processing solution.

Hitherto, according to the U.S. patent application, Ser. No. 019,580, a good sheet formation and a sufficient surface quality could be achieved with some certainty only with acid sized papers. However, in many cases, an acid sizing is not desirable because the sensitivity of photographic layers can thereby be decreased.

However, even papers according to the U.S. patent application, Ser. No. 019,580, can be improved. It is disadvantageous that, in case of the use of two differently charged polyacryl amides, two mixing stations and two metering stations are necessary. It is further disadvantageous that the metering of the two components cannot be precisely coordinated with respect to each other because, on the one hand, the electrochemical character of the two polyacryl amide types in solution is not stable and, on the other hand, the electrochemical behavior of the fibers is subject to continuous variations. It results therefrom that the internal strength and structural strength and the sheet structure are subject to variations, which so far have been neither reliably explained nor controlled.

The disadvantage of the state of the art described above is that none of the so far described methods is suitable both for "neutral" sized papers with reactive sizing agents as well as for "acid" sized papers with non-reactive sizing agents. For example, in an attempt to transfer, for example, the teaching of the U.S. patent application, Ser. No. 019,580, to a neutral sized paper, all the disadvantages of the teachings of the U.S. Pat. No. 4,439,496 reappear. The described, unexplainable variations in the structural strength, the sheet structure, and the edge penetration, together with bad sheet formation and bad surface quality.

SUMMARY OF THE INVENTION

1. Purposes of the Invention

It is an object of the present invention to make available a base paper for photographic layer carriers, which avoids the described disadvantages.

It is a further object of the present invention to provide a base paper for photographic layer carriers, which is improved particularly concerning sheet formation, surface quality, and internal strength and structural strength.

It is yet another object of the present invention to provide a base paper for photographic layer carriers, which avoids edge penetration of developing solutions and which retains important advantageous properties.

It is yet a further object of the invention to provide a method for the production of a base paper for photographic layer carriers, which improves the recited parameters both using so-called acid sizing as well as so-called neutral sizing and which avoids undesirable variations of these properties and the penetration of photographic solutions into the edge regions.

These and other objects and advantages of the present invention will become evident from the description which follows.

2. Brief Description of the Invention

In accordance with the present invention, a base paper for photographic layer carriers comprises a sizing agent applied to a paper sheet for conveying hydrophobic properties to the sheet. An amphoteric member of the group consisting of polyacryl amide, polymethacryl amide and mixtures thereof, is applied to the paper sheet for conveying structural strength and flocculation-suppressing properties. A cationic resin is applied to the paper for conveying wet-strength properties.

The amphoteric member of the group consisting of polyacryl amide, polymethacryl amide and mixtures thereof can be a copolymer which comprises at least 40 mole-percent acrylamide groups and/or methacryl amide groups.

The molar ratio of acrylamide groups and/or methacryl amide groups relative to the sum of the anionic and cationic groups can have a value of from 60:40 to 95:5.

The molar ratio of the sum of the cationic groups in the amphoteric member of the group, consisting of polyacryl amide, polymethacryl amide and mixtures thereof, to the sum of the anionic groups in the amphoteric member of the group, consisting of polyacryl amide, polymethacryl amide and mixtures thereof, can amount to from about 10:1 to 1:2.

The cationic groups can be present in quaternary or in protonized configuration in the amphoteric member of the group consisting of polyacryl amide, polymethacryl amide and mixtures thereof.

The hydrophobic-properties conveying sizing agent can include a reactive sizing agent. The hydrophobic-properties conveying sizing agent can include a non-reactive sizing agent and can comprise at least a salt of a polivalent metal. The hydrophobic-properties conveying sizing agent can include a combination of one reactive and of one non-reactive sizing agent.

The wet-strength-properties conveying cationic resin can be a resin formed of a member of the group consisting of the polyamide-polyamine, polyamine, polyimine, or polyacrylamide amine, polymethacrylamide amine modified with epichlorohydrine. The wet-strength-properties conveying cationic resin can be a polyamide-polyamine-epichlorohydrine resin or another suitable resin.

A method for the production of a base paper for photographic layer carriers comprises the following steps. A paper pulp suspension is prepared including cellulose. A hydrophobic-properties-conveying sizing agent is added to the paper pulp suspension. An amphoteric member of the group consisting of polyacryl amide, polymethacryl amide and mixtures thereof is added to the paper pulp suspension. A cationic resin is added conveying wet-strength properties, and a paper is produced of this suspension.

The amphoteric member of the group consisting of polyacryl amide, polymethacryl amide and mixtures thereof can be added ahead of the cationic resin to the paper pulp suspension and the addition of the sizing agent can occur before the amphoteric member of the group consisting of polyacryl amide, polymethacryl amide and mixtures thereof.

The amphoteric member of the group consisting of polyacryl amide, polymethacryl amide and mixtures thereof can be added ahead of the cationic resin to the paper pulp suspension and the addition of the sizing agent can occur before the addition of the cationinc resin.

DESCRIPTION OF INVENTION AND PREFERRED EMBODIMENT

In accordance with the invention, a base paper is employed for the laminate production which comprises, in addition to hydrophobic-properties conveying sizing agents, at least one cationic resin and at least one amphoteric polyacryl amide.

Thus, the invention relates to a base paper for resin-coated photographic layer carriers as well as to a method for the production of a base paper, which comprises at least a hydrophobic-properties conveying sizing agent, at least a cationic resin, and at least an amphoteric polyacryl amide.

Hydrophobic properties conveying sizing agents according to the invention are both reactive sizing agents, such as dimerized alkyl ketenes, epoxidized fatty acid amides, or fatty acid anhydrides, as well as non-reactive sizing agents, such as higher fatty acids as, for example, stearic acid, and salts of higher fatty acids. In case of the use of a non-reactive sizing agent, polyvalent metal ions in the form of a salt, such as aluminum sulfate or sodium aluminate, are additionally added to the paper material, and the pH value is set to a usual value of from between pH=4 and pH=6. Polyvalent metal ions can also be employed together with reactive sizing agents in individual cases.

A particularly preferred dimerized alkyl ketene comprises at least 50% of behenyl ketene or docosyl ketene or another alkyl ketene with more than 18 carbon atoms in the alkyl radical. The hydrocarbon radical of the ketene can also comprise ring structures or carbon-carbon double bonds.

According to further embodiments of the invention, there are contained two or more hydrophobic-properties-conveying sizing agents in the paper. Reactive sizing agents can be combined with non-reactive sizing agents in this case. A preferred combination includes, for example, a combination of alkyl ketene dimer and fatty acid, but also a combination of an epoxidized fatty acid amide and fatty acid is possible within the framework of the invention.

A cationic resin is every resin used in the paper production as a wet-strength agent with cationic groups. Such resins usually serve for the wet-strengthing and for the retaining of reactive sizing agents. The resins are employed according to the invention, however, both in combination with reactive as well as with non-reactive sizing agents. According to a preferred embodiment, the cationic resin is a polyamine or polyamide amine resin, modified with epichlorohydrine. Other suitable resins include urea/formaldehyde resins, melamine/formaldehyde resin, polyethylene imine, and polyethylene imine derivatives.

The third component required for the success of the invention is the amphoteric polyacryl amide. This is a polyacryl amide which contains both, anionic groups as well as cationic groups in the macromolecule. The anionic groups include carboxyl or, respectively, alkalicarboxylate groups. The cationic groups can be arbitrary cationic groups. Preferred cationic groups include, however, quaternary or protonized alkylene aminoalkylene acrylate and alkylene aminoalkylene methacrylate, or alkyl aminoalkylene acrylamide and alkyl aminoalkylene methacryl amide groups, where a quaternization is achieved preferably with dimethyl sulfate or methyl chloride, and where salts of the protonized form are preferably sulfuric acid or hydrochloric acid salts.

The introduction of cationic groups into a polyacryl amide or into a polymethacryl amide occurs in general by way of a copolimerization in the presence of respective cationic monomers, such as, for example, dialkyl aminoalkylene acrylate or dialkyl aminoalkylene methacrylate, or dialkyl aminoalkylene acrylamide or dialkyl aminoalkylene methacrylamide in the form of acid salts or in a quaternary form. A suitable cationic comonomer is also dimethyl-diallyl-ammonium-chloride. Cationic groups, however, can also be formed by reaction of polyacryl amide according to Mannich or Hoffmann or by transamination with polyamine.

Similarly, also the anionic groups are present in the amphoteric polyacryl amide, either as a result of a copolymerization in the presence of, for example, acrylic acid, methacrylic acid or, respectively, their salts or they are the result of a hydrolysis of acryl amide groups or of copolymerized acrylic acid esters or methacrylic acid esters.

The molecular weight of the amphoteric polyacryl amide is in the area of from 100,000 to 2,000,000, and is preferably between 500,000 and 1,500,000.

The polyacryl amide (PAA) is a modified polyacryl amide or polymethacryl amide, where the molar ratio of the amide components to the sum of the anionic and cationic groups is preferably in the region of from about 60:40 to 95:5. The ratio of the number of the cationic groups to the number of the anionic groups is between 10:1 and 1:2. The polyacryl amide or polymethacryl amide being used can contain up to 10 mole-percent of a fourth comonomer such as, for example, acrylic acid ester, vinyl ester, or others. The amount employed according to the invention amounts to 0.3–3.0 weight-percent relative to the weight of the fiber material.

Surprisingly, there results that, according to the invention, addition of the amphoteric polyacryl amide to the cellulose suspension, the flocculation generated by the cationic resin is substantially decreased or even completely eliminated. This effect appears even in such cases where, in addition, small amounts of anionic strengthening agents are added to the paper mass.

Contrary to apprehension, the edge penetration of the photographic process solutions is not increased based on the process of the invention, and the splitting of the edges in photographic process solutions does not occur, as is observed in case of non-ionic additives.

Referring to an average value of the surface number and of the edge penetration of more than ±5% and of the internal strength of more than ±6% are designated as undesired variations (see definition below).

Contrary to expectation, dewatering is not decreased and the decisive strengthening values are surprisingly better than in the case of the use of combinations of anionic and cationic polyacryl amides. It is finally a particular advantage that the described favorable results are obtained with small differences, both in the case of neutral-sized as well as in the case of acid-sized papers.

Sized and strengthened papers according to the invention can contain all otherwise usual paper auxiliaries and additives such as pigments, coloring agents, fillers, optical brighteners, antioxidants, or parts of synthetic fiber materials without that the advantages, according to the invention, are lost.

Within the framework of the invention, the various components can be added to the cellulose suspension in different sequences and at different stages well known to the paper producer. Usually, fatty acids, fatty acid anhydrides, and aluminum compounds are added immediately after the refining of the cellulose fibers, whereas reactive sizing agents are added to the cellulose suspension relatively shortly before the feeding to the paper machine.

The amphoteric polyacryl amide can be added in the course of the paper production both to the so-called high-density pulp stock as well as to the so-called low-density pulp stock. The sequence of the addition can be different for the three components which are important according to the invention. Any sequence is possible in principle. According to a preferred embodiment for the achievement of optimum results, the amphoteric polyacryl amide is admixed into the fiber material suspension in the sequence before the cationic resin. Otherwise, the rules known to a person skilled in the papermaking art are valid.

The invention idea is explained by way of the following examples.

EXAMPLE 1

A mixture of 90 weight-percent of hardwood sulfate pulp and 10 weight-percent softwood sulfate pulp was refined at a material density of 4% to a refining degree of 35° SR. Then a sizing agent, amphoteric polyacrylic amide (PAA), cationic resin, and auxiliary materials according to Table 1, were added to the cellulose suspension. 175 g/sq.m. heavy base papers were produced from the suspension diluted to 1.2 weight-percent in a conventional way. The papers were surface-sized also in a conventional way with a solution which contained 52 g/l of oxidized starch, 20 g/l sodium chloride, and 1 g/l of optical brighteners, and they were calandered in-line.

TABLE 1

Additives and Amounts According to Example 1 (All quantity amounts in this and the following tables are given in weight-percent relative to the amount of fiber material present.)

| | Sample | | | | |
|---|---|---|---|---|---|
| | 1.1 | 1.2 | 1.3 | 1.4 | 1.5 |
| Stearic acid | 1.0 | 1.0 | 1.0 | 1.0 | 1.0 |
| Aluminum sulfate | 1.0 | 1.0 | 1.0 | 1.0 | 1.0 |
| Amphoteric PAA Ia | 1.0 | — | — | — | — |
| Amphoteric PAA Ib | — | 1.0 | — | — | — |
| Amphoteric PAA Ic | — | — | 1.0 | — | — |
| Amphoteric PAA Id | — | — | — | 1.0 | — |
| Amphoteric PAA IId | — | — | — | — | 1.0 |
| Polyamide-polyamine epichlorohydrine resin | 0.5 | 0.5 | 0.5 | 0.5 | 0.5 |
| $H_2SO_4$ | up to pH = 4.5 | | | | |

COMPARISON EXAMPLE 1

Corresponding to Example 1, as a comparison, the samples 1.6 to 1.8 were produced without amphoteric polyacryl-amide (PAA) with the deviations 1.6—no polyacryl-amide
1.7—with 1 weight-percent cationic polyacryl-amide
1.8—with 1 weight-percent anionic polyacryl-amide.

EXAMPLE 2

Analog to Example 1, base papers with a weight of about 175 g/sq.m. were produced with the compounds recited in Table 2.

TABLE 2

Compounds and Amounts According to Example 2

| | Sample | | | | | |
|---|---|---|---|---|---|---|
| | 2.1 | 2.2 | 2.3 | 2.4 | 2.5 | 2.6 |
| Sodium stearate | 0.5 | 0.5 | 0.5 | 0.5 | 0.5 | 0.5 |
| Sodium aluminate | 0.5 | 0.5 | 0.5 | 0.5 | 0.5 | 0.5 |
| Amphoteric PAA IIa | 1.0 | — | — | — | — | — |
| Amphoteric PAA IIb | — | 1.0 | — | — | — | — |
| Amphoteric PAA IIc | — | — | 1.0 | — | — | 0.5 |
| Amphoteric PAA IId | — | — | — | 1.0 | — | — |
| Amphoteric PAA IV | — | — | — | — | 1.0 | — |
| Anionic PAA (10 mole-percent anionic groups) | — | — | — | — | — | 0.5 |
| Alkyl ketene dimer | 0.4 | 0.4 | 0.4 | 0.4 | 0.4 | 0.4 |
| Polyamide-polyamine-epichlorohydrine resin | 0.5 | 0.5 | 0.5 | 0.5 | 0.5 | 0.5 |
| $H_2SO_4$ | up to pH = 5.5 | | | | | |

COMPARISON EXAMPLE 2

Corresponding to Example 2, the Samples 2.7 and 2.8 were produced without amphoteric polyacryl-amide (PAA).

2.7—with 1 weight-percent cationic polyacryl-amide (PAA)
2.8—with 0.5 weight-percent anionic polyacryl-amide (PAA)

EXAMPLE 3

Analog to Example 1, about 175 g/sq.m. heavy base papers were produced with the compounds recited in Table 3.

TABLE 3

Compounds and Amounts According to Example 3

| | Samples | | | | | | |
|---|---|---|---|---|---|---|---|
| | 3.1 | 3.2 | 3.3 | 3.4 | 3.5 | 3.6 | 3.7 |
| Anionic starch | 1.0 | 1.0 | 1.0 | 1.0 | — | — | — |
| Cationic starch | — | — | — | — | 0.5 | — | — |
| Amphoteric PAA IIIa | 1.0 | — | — | — | — | — | — |
| Amphoteric PAA IIIb | — | 1.0 | — | — | — | — | — |
| Amphoteric PAA IIIc | — | — | 1.0 | — | — | 0.5 | 2.5 |
| Amphoteric PAA IIId | — | — | — | 1.0 | — | — | — |
| Amphoteric PAA IId | — | — | — | — | 1.0 | — | — |
| Cationic PAA | — | — | — | — | — | 0.5 | — |
| Alkyl-ketene-dimer | 0.6 | 0.6 | 0.6 | 0.6 | 0.6 | 0.6 | 0.6 |
| Polyamide-polyamine-epichlorohydrine resin | 1.0 | 1.0 | 1.0 | 1.0 | 1.0 | 1.0 | 0.5 |
| Epoxidized fatty acid amide | 0.1 | 0.1 | 0.1 | 0.1 | 0.1 | — | — |

COMPARISON EXAMPLE 3

Corresponding to Example 3.1, the samples 3.8 and 3.9, as well as corresponding to Example 3.6, the samples 3.10 and 3.11 were produced without amphoteric polyacryl-amide.

3.8—no polyacryl-amide
3.9—with 1 weight-percent cationic polyacryl-amide
3.10—with 0.5 weight-percent cationic polyacryl-amide
3.11—no polyacryl-amide

EXAMPLE 4

Analog to Example 1, base papers with a weight of 175 g/sq.m. were produced with the compounds cited in Table 4.

TABLE 4

Compounds and Amounts According to Example 4

| | Samples | | | | | |
|---|---|---|---|---|---|---|
| | 4.1 | 4.2 | 4.3 | 4.4 | 4.5 | 4.6 |
| Sodium stearate | 0.5 | 0.5 | 0.5 | 0.5 | 0.5 | — |
| Aluminum chloride | 0.5 | 0.5 | 0.5 | 0.5 | 0.5 | — |
| Amphoteric PAA IIIc | 1.5 | 2.0 | 2.5 | — | — | 2.5 |
| Amphoteric PAA IId | — | — | — | 2.0 | — | — |
| Amphoteric PAA IV | — | — | — | — | 2.0 | — |
| Alkyl-ketene-dimer | 0.5 | 0.5 | 0.5 | 0.5 | 0.5 | 0.5 |
| Polyamide-polyamine-epichlorohydrine resin | 0.5 | 0.5 | 0.5 | 0.5 | 0.5 | 0.5 |
| $H_2SO_4$ | up to pH = 5.5 | | | | | — |

COMPARISON EXAMPLE 4

Corresponding to Example 4, the samples 4.7 to 4.9 were produced without amphoteric polyacryl-amide (PAA).

4.7—without polyacryl-amide
4.8—with 0.5 weight-percent anionic polyacryl-amide (PAA)
4.9—with 0.5 weight-percent cationic polyacryl-amide (PAA)

| | Sample | |
|---|---|---|
| | 5.1 | 5.2 |
| Cationic PAA | 1.0 | 2.5 |
| Alkyl-ketene-dimer | 0.6 | 0.6 |
| Polyamide-polyamine-epichloro-hydrine resin | 0.5 | 0.5 |

COMPARISON EXAMPLE 6

Analog to Example 1, the paper samples were produced employing the technical teaching of the U.S. Pat. No. 4,439,496 with the following compounds.

| | Sample | |
|---|---|---|
| | 6.1 | 6.2 |
| Cationic PAA | 0.5 | 0.7 |
| Anionic PAA | 0.5 | 0.3 |
| Alkyl-ketene-dimer | 0.6 | 1.0 |
| Polyamide-polyamine-epichloro-hydrine resin | 0.5 | 0.5 |

COMPARISON EXAMPLE 7

Analog to Example 1, paper samples were produced employing the technical teaching of the U.S. Pat. No. 4,665,014 with the following compounds.

| | Sample | |
|---|---|---|
| | 7.1 | 7.2 |
| Cationic starch | 2.5 | 2.5 |
| Anionic PAA | 0.3 | 0.3 |
| Alkyl-ketene-dimer | 0.5 | 0.5 |
| Epoxidized fatty acid amide | 0.3 | — |
| Polyamide-polyamine-epichloro-hydrine resin | — | 0.5 |

The alkyl-ketene-dimer, cited in the examples, is a commercial product which is synthesized from a commercially available mixture of stearic acid and palmitic acid, i.e. it carries predominantly $C_{16}$-alkyl groups. In additional tests, it was determined that the results are similar in principle if other ketene-dimers are employed. Particularly advantageous results relative to the edge penetration and the structural strength were achieved if, according to the U.S. application Ser. No. 108,746, a ketene-dimer is employed, which contains less than 40 weight-percent hydrocarbon groups with less than 20 carbon atoms. Such a preferred ketene-dimer is, for example, behenyl-ketene-dimer or docosyl-ketene-dimer.

It was determined in further tests that the invention effect is not limited to the basis weight of the base paper and the cited cellulose types of the examples. The effect of an addition of amphoteric polyacryl-amide is independent of the basis weight, of the kind of fibers, and of the possibly additional usual auxiliary agents such as, for example, fillers.

The amphoteric polyacryl-amides or polymethacryl-amides used in the examples are composed as follows:

PAA I is a copolymeric polyacryl-amide with 15 mole-percent of dimethyl-aminoethyl-acrylate, quaternized with dimethyl-sulfate, which comprises, according to following table, different amounts of acrylic acid and sodium acrylate:

PAA Ia: 2 mole-percent
PAA Ib: 4 mole-percent
PAA Ic: 7 mole-percent
PAA Id: 10 mole-percent

PAA II is a copolymeric polyacryl-amide with 7 mole-percent of dimethyl-aminoethyl-methacrylate formed as a sulfuric acid salt, which comprises, according to the following table, different amounts of acrylic acid and sodium acrylate:

PAA IIa: 2 mole-percent
PAA IIb: 4 mole-percent
PAA IIc: 7 mole-percent
PAA IId: 10 mole-percent

PAA III is a copolymeric polyacryl amide with 10 mole-percent of dimethyl-aminopropyl-acrylamide, quaternized with methyl chloride which comprises, according to the following table, different amounts of acrylic acid and sodium acrylate:

PAA IIIa: 2 mole-percent
PAA IIIb: 4 mole-percent
PAA IIIc: 7 mole-percent
PAA IIId: 10 mole-percent

PAA IV is a copolymeric polymethacryl amide with 10 mole-percent of dimethyl-aminoethyl-acrylate formed as a hydrochloric acid salt and with 10 mole-percent of methacrylic acid.

Of the paper samples produced according to the examples and the comparison examples, in each case, one part was left uncoated and was tested, and another part was coated on two sides in a conventional way with polyethylene and was subjected to a test in this configuration. The following test methods were employed for the evaluation within the framework of the invention.

SURFACE NUMBER (OZ)

The test was performed with uncoated paper samples according to the test method described in German Patent DE-OS 34 26 782. The surface number can be deemed to be equivalent to the formation according to the determinations made. The numbers in the following tables are, in each case, average values of five individual measurements.

STRUCTURAL STRENGTH (SC.B.)

The structural strength, or internal strength, was determined according to TAPPI RC 308 with a Scott Bond interlaminar strength tester (Internal Bond Impact Tester Model B). The numeric values in the following tables are, in each case, average values out of five individual measurements.

EDGE PENETRATION OF THE DEVELOPER (KE)

The paper samples coated with polyethylene were cut and were dipped in the required sample size for 14 minutes in a commercially available color developer bath (T=30° C.). After intermediate water treatment, a treatment with a commercially available fixing solution, and final watering, the samples were dried and the penetration depth of the developer solution was measured at the cut edge in millimeters using a suitable magnifying glass. The zone of the developer penetration is recognized as a more or less brownish stained edge, in transmitted light. The numeric values in the following tables are, in each case, average values out of six individual measurements.

Further, stiffness, tensile strength, adhesion of the polyethylene layers, and photo-chemical properties were tested routinely. The results are, however, within the known areas and were not used in the evaluation of the invention.

The results of the described tests are summarized in Tables 5 and 6. Table 5 contains the test results obtained with the invention papers of Examples 1 to 4, and Table 6 contains the test results obtained with the invention papers of the Comparison Examples 1 to 7.

As recited, the test data contained in the tables are, in each case, average values of five or, respectively, six individual measurements. In the case of the invention examples, variations were observed in no case, which reached, relative to the average value, ±5% or even exceeded such values. Even in case of measurements at different rolls of the invention examples, the test values were surprisingly constant. In case of the comparison examples, however, the variations in part were ±10%, however, in no case under ±5%.

It is decisive for the evaluation of the invention that the high surface quality is achieved in connection with a high structural strength. The surface quality is expressed in the low surface number which, even in the case of the naturally bad mixture of Example 3, still reaches a good level. The good structural strength corresponds to the high "Scott-Bond-Values" of Table 5. In each case, comparable systems of Table 6 have to be compared.

TABLE 5

Test Results Obtained with the Examples 1 to 4

| Sample | Surface Number OZ | Scott-Bond Sc.B. (fl.lb/sq.in) | Edge Penetration KE (mm) |
|---|---|---|---|
| 1.1 | 112 | 148 | 0.61 |
| 1.2 | 101 | 156 | 0.57 |
| 1.3 | 90 | 165 | 0.50 |
| 1.4 | 97 | 161 | 0.52 |
| 1.5 | 102 | 158 | 0.55 |
| 2.1 | 118 | 160 | 0.53 |
| 2.2 | 102 | 175 | 0.51 |
| 2.3 | 96 | 180 | 0.45 |
| 2.4 | 97 | 174 | 0.50 |
| 2.5 | 95 | 175 | 0.49 |
| 2.6 | 100 | 169 | 0.54 |
| 3.1 | 160 | 219 | 0.54 |
| 3.2 | 143 | 227 | 0.51 |
| 3.3 | 130 | 240 | 0.48 |
| 3.4 | 139 | 235 | 0.49 |
| 3.5 | 141 | 229 | 0.52 |
| 3.6 | 151 | 231 | 0.53 |
| 3.7 | 136 | 240 | 0.51 |
| 4.1 | 101 | 195 | 0.43 |
| 4.2 | 113 | 216 | 0.42 |
| 4.3 | 117 | 224 | 0.40 |

TABLE 5-continued

Test Results Obtained with the Examples 1 to 4

| Sample | Surface Number OZ | Scott-Bond Sc.B. (fl.lb/sq.in) | Edge Penetration KE (mm) |
|---|---|---|---|
| 4.4 | 115 | 220 | 0.45 |
| 4.5 | 115 | 225 | 0.47 |
| 4.6 | 156 | 261 | 0.48 |

TABLE 6

Test Results Obtained with the Comparison Examples 1 to 4

| Sample | Surface Number OZ | Scott-Bond Sc.B. (fl.lb/sq.in) | Edge Penetration KE (mm) |
|---|---|---|---|
| 1.6 | | | |
| 1.7 | 188 | 149 | 0.72 |
| 1.8 | | | |
| 2.7 | 141 | 155 | 0.57 |
| 2.8 | 147 | 145 | 0.60 |
| 3.8 | 140 | 168 | 0.59 |
| 3.9 | 179 | 210 | 0.55 |
| 3.10 | 181 | 186 | 0.60 |
| 3.11 | 132 | 142 | 0.62 |
| 4.7 | 145 | 160 | 0.53 |
| 4.8 | 167 | 175 | 0.50 |
| 4.9 | 185 | 201 | 0.45 |
| 5.1 | 170 | 199 | 0.55 |
| 5.2 | 240 | 250 | 0.52 |
| 6.1 | 191 | 210 | 0.50 |
| 6.2 | 183 | 195 | 0.47 |
| 7.1 | 260 | 175 | 0.80 |
| 7.2 | 279 | 218 | 0.50 |

It will be understood that each of the elements described above, or two or more together, may also find a useful application in other types of base papers for photographic layer supports differing from the types described above.

While the invention has been illustrated and described as embodied in the context of a base paper for waterproof coated paper carriers for photographic layers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A base paper for photographic layer carriers comprising a paper sheet;

a sizing agent in amounts sufficient to convey hydrophobic properties to the sheet;

an amount of water soluble amphoteric member to increase the internal and structural strength of said amphoteric polymer selected from the group consisting of amphoteric polyacryl amide, amphoteric polymethacryl amide and mixtures thereof, wherein the ratio of the number of cationic groups to the number of anionic groups of the polyacrylamide is between 10:1 and 1:2;

a cationic resin in an amount sufficient to convey wet-strength to the paper base; wherein cationic resin is selected from the group consisting of the polyamide-polyamine, polyamine, polyimine, or polyacrylamide amine, polymethacrylamide amine modified with epichlorohydrine.

2. The base paper according to claim 1, wherein the amphoteric member of the group consisting of polyacryl amide, polymethacryl amide and mixtures thereof is a copolymer which comprises at least 40 mole-percent acrylamide groups and/or methacryl amide groups.

3. The base paper according to claim 1, wherein the molar ratio of acrylamide groups and/or methacryl amide groups relative to the sum of the anionic and cationic groups has a value of from 60:40 to 95:5.

4. The base paper according to claim 1, wherein cationic groups are present in quaternary configuration in the amphoteric member of the group consisting of amphoteric polyacryl amide, amphoteric polymethacryl amide and mixtures thereof.

5. The base paper according to claim 1, wherein cationic groups are present in protonized configuration in the amphoteric member of the group consisting of amphoteric polyacryl amide, amphoteric polymethacryl amide and mixtures thereof.

6. The base paper according to claim 1, wherein the hydrophobic-properties conveying sizing agent includes a reactive sizing agent.

7. The base paper according to claim 1, wherein the hydrophobic-properties conveying sizing agent includes a non-reactive sizing agent and comprises at least a compound of a polyvalent metal.

8. The base paper according to claim 1, wherein the hydrophobic-properties conveying sizing agent includes a combination of one reactive and one non-reactive sizing agent.

9. The base paper according to claim 1, wherein the cationic resin providing wet-strength is a polyamide-polyamine-epichlorohydrine resin.

10. The base paper according to claim 1, wherein the hydrophobic-properties conveying sizing agent is a combination of at least one reactive and at least one non-reactive sizing agent and where wet-strength properties are conveyed by a cationic resin formed of polyamide-polyamine-epichlorohydrine resin.

11. A method for the production of a base paper for photographic layer carriers comprising preparing a paper pulp suspension including cellulose; adding a hydrophobic-properties-conveying sizing agent to the paper pulp suspension in an amount sufficient to convey hydrophobic properties to the sheet;

adding an amount of water soluble amphoteric polymer to increase the internal and structural strength of said amphoteric polymer selected from the group consisting of amphoteric polyacryl amide, amphoteric polymethacryl amide and mixtures thereof to the paper pulp suspension wherein the ratio of the number of cationic groups to the number of anionic groups of the polyacrylamide is between 10:1 and 1:2;

adding a cationic resin in an amount sufficient to convey wet-strength to the paper base and forming a paper from said suspension.

12. The method for the production of a base paper according to claim 11, wherein the amphoteric member of the group consisting of amphoteric polyacryl amide, amphoteric polymethacryl amide and mixtures thereof is added ahead of the cationic resin to the paper pulp suspension and the addition of the sizing agent occurs before the amphoteric member of the group consisting of amphoteric polyacryl amide, amphoteric polymethacryl amide and mixtures thereof.

13. The method for the production of a base paper according to claim 11, wherein the amphoteric member of the group consisting of amphoteric polyacryl amide, amphoteric polymethacryl amide and mixtures thereof is added ahead of the cationic resin to the paper pulp suspension and the addition of the sizing agent occurs before the addition of the cationic resin.

14. The method according to claim 11, wherein the amphoteric polyacryl amide or polymethacryl amide is a copolymer which comprises at least 40 mole-percent acrylamide groups and/or methacryl amide groups.

15. The method according to claim 11, wherein the molar ratio of the acrylamide groups and/or methacryl amide groups relative to the sum of the anionic and cationic groups has a value of from 60:40 to 95:5; and wherein the molar ratio of the sum of the cationic groups in the polyacryl amide and/or polymethacryl amide relative to the sum of the anionic groups in the polyacryl amide and/or polymethacryl amide amounts from 10:1 to 1:2.

16. The base paper according to claim 15, wherein the cationic groups in the polyacryl amide and/or polymethacryl amide are present in quaternary or protonized configuration;

wherein the hydrophobic-properties conveying sizing agent is at least a reactive sizing agent, wherein the cationic groups in the polyacryl amide and/or polymethacryl amide are present in quaternary or protonized configuration;

and wherein the hydrophobic-properties conveying sizing agent is at least a non-reactive sizing agent and comprises at least a compound of a polyvalent metal.

* * * * *